US005949015A

United States Patent [19]

Smith et al.

[11] Patent Number: 5,949,015

[45] Date of Patent: Sep. 7, 1999

[54] WEAPON CONTROL SYSTEM HAVING WEAPON STABILIZATION

[75] Inventors: Steve Smith, Northampton; Mark Fydenkevez, Longmeadow, both of Mass.; Chong-Ket Chuah, Ashburn, Va.; Dave Thibodeau, Belchertown, Mass.

[73] Assignee: Kollmorgen Corporation, Waltham, Mass.

[21] Appl. No.: 08/895,015

[22] Filed: Jul. 16, 1997

Related U.S. Application Data

[63] Continuation-in-part of application No. 08/855,919, May 14, 1997, abandoned.

[51] Int. Cl.[6] ..... F41G 3/16

[52] U.S. Cl. ..... 89/41.05; 89/41.09; 89/40.03; 89/40.04

[58] Field of Search ..... 89/41.05, 41.06, 89/1.11, 41.21, 41.22, 41.09, 41.14, 41.17, 40.03, 40.04

[56] References Cited

U.S. PATENT DOCUMENTS

| | | | |
|---|---|---|---|
| 3,711,638 | 1/1973 | Davies | 89/41.05 |
| 3,844,196 | 10/1974 | Taylor et al. | 89/41.09 |
| 4,028,991 | 6/1977 | Kuby | 89/41.21 |
| 4,386,848 | 6/1983 | Clendenin et al. | 89/41.05 |
| 4,528,891 | 7/1985 | Brunello et al. | 89/41.05 |
| 4,644,845 | 2/1987 | Garehime, Jr. | 89/41.05 |
| 5,456,157 | 10/1995 | Lougheed et al. | 89/134 |
| 5,686,690 | 11/1997 | Lougheed et al. | 89/41.17 |

OTHER PUBLICATIONS

Weaver, J.D., Project Manager for Light Tactical Vehicles, PEO Tactical Wheeled Vehicles, *A Context for Wheeled Armored Vehicles: Where Are We Now?–Where Can We Go?*, Presentation to the U.S. Army Conference, Sep. 26, 1996, Fort Knox, KY. pp. 1–13.

Rafael, *OWS 7.62, Overhead Weapon Station For 7.62MM Machine Gun*, Platform & Launchers Directorate.

Rafael, *OWS 25, Overhead Weapon Station For 25MM Cannon*, Platform & Launchers Directorate.

Rafael, *OWS 12.7DE, Overhead Weapon Station For 12.7MM Machine Gun*, Platform & Launchers Directorate.

Rafael, *OWS 12.7DI, Overhead Weapon Station For 12.7MM Machine Gun*, Platform & Launchers Directorate.

*Shipboard Stabilized Weapon System*, Kollmorgan Electro–Optical, ER400.1091 Rev A. No publication date. However tested on Feb. 1995.

*Primary Examiner*—Stephen M. Johnson

*Attorney, Agent, or Firm*—Morgan & Finnegan, L.L.P.

[57] ABSTRACT

A weapon control system is disclosed which includes system electronics providing control and drive electronics for the weapon control system, a weapon mount for supporting and firing a weapon in accordance with commands from the system electronics, a remote control including a visual display and hand controls for operational control of the weapon control system from a position distant from said weapon mount, and a system disconnect for removal of control of the weapon from the weapon control system and for safety interlock to prevent accidental firing of the weapon. The weapon mount is adapted to support and fire a variety of weapons. A gyro stabilization assembly is mounted on the weapon mount and operatively connected to the remote control and the system electronics for allowing line-of-sight weapon and integral sight stabilization.

27 Claims, 13 Drawing Sheets

WEAPON CONTROL SYSTEM HAVING WEAPON STABILIZATION

This application is a continuation-in-part of patent application Ser. No. 08/855,919 entitled Weapon Control System, filed on May 14, 1997, now abandoned, by the same inventors.

FIELD OF THE INVENTION

The invention relates to systems for remote control of weapon systems, and more particularly, to systems for remote target acquisition and weapon firing for vehicle mounted weapons with weapon stabilization.

BACKGROUND OF THE INVENTION

Wheeled vehicles provide better mobility than tracked vehicles in some situations such as dense forests, urban areas and some soft soils. The generally smaller size and lighter weight result in better transportability and easier deployment. Due to the lower weight, smaller size and inherent simplicity of wheeled vehicles the operational and support cost is lower than for tracked vehicles. Finally, in the highly political peacekeeping arena, the wheeled vehicle projects less threat while providing a reasonable level of protection and fire power.

With modern technology, wheeled vehicles now possess significant survivability. Vehicle survivability on the battlefield is achieved through a combination of characteristics including armor, agility, and the ability to respond to an aggressor.

There has been an impressive array of weapons that have been mounted on wheeled vehicles as a mobile platform to respond to an aggressor. The primary limitation of these weapons as a survivability factor is the speed of response and the protection of the gunner. For example, missiles are highly lethal but cannot be fired quickly or on the move. They are more of a stand-off, defensive, or ambush system than a direct offensive system, or one that can be used in response to a spontaneous lethal encounter. Small caliber weapons are effective against soft and lightly armored targets, but the gunner is exposed and the response time is variable depending on the situation and conditions. Further, the accuracy of the response is limited, based on the ability of the gunner and whether the vehicle is moving or stationary.

Thus, there was a need in the art for a weapon control system that is applicable to any vehicle or tripod mounted weapon that will permit target acquisition and firing of the weapon from inside the vehicle.

In the copending parent application, the above deficiencies were overcome by a Weapon Control System having a remotely controlled, two-axis weapon platform for vehicle mounted weapons such as MK19, M2, or M60 machine guns. The disclosed Weapon Control System included four basic components: Weapon Mount, Electronics Unit, Remote Control Unit, and Hull Turret Disconnect. The Weapon Control System can be operated in either a Local Mode or a Remote Mode. Operation in the Local Mode is identical to operation of a standard vehicle weapon mount. Operation in the Remote Mode allows target viewing, slewing, and firing of the weapon from within a vehicle.

However, accuracy and stable targeting is also essential.

SUMMARY OF THE INVENTION

In accordance with the present invention, a Weapon Control System has system electronics providing control and driver electronic for the Weapon Control System. A weapon mount supports and fires a weapon in accordance with commands from the system electronics. A remote control includes a visual display and hand controls for operational control of the weapon control system from a position distant from the weapon mount. A system disconnect removes the control of the weapon from the weapon control system. Safety inner lock prevents accidental firing of the weapon. The weapon mount will support and fire a variety of weapons in a gyro stabilization assembly and is mounted on the weapon mount and operatively connected to the remote control and the system electronics for line-of-sight weapon and integral sight stabilization.

The gyro stabilization assembly also includes at least one gyro for sensing elevation and train rate error. The gyro stabilization assembly has a null corrected drift rate less than five degrees/hour. The null corrected drift rate can be adjusted in azimuth and elevation.

BRIEF DESCRIPTION OF THE DRAWINGS

The accompanying drawings, referred to herein and constituting a part hereof, illustrate preferred embodiments of the invention and, together with the description, serve to explain the principles of the invention, wherein.

DETAILED DESCRIPTION OF THE DRAWINGS

Figure 1:
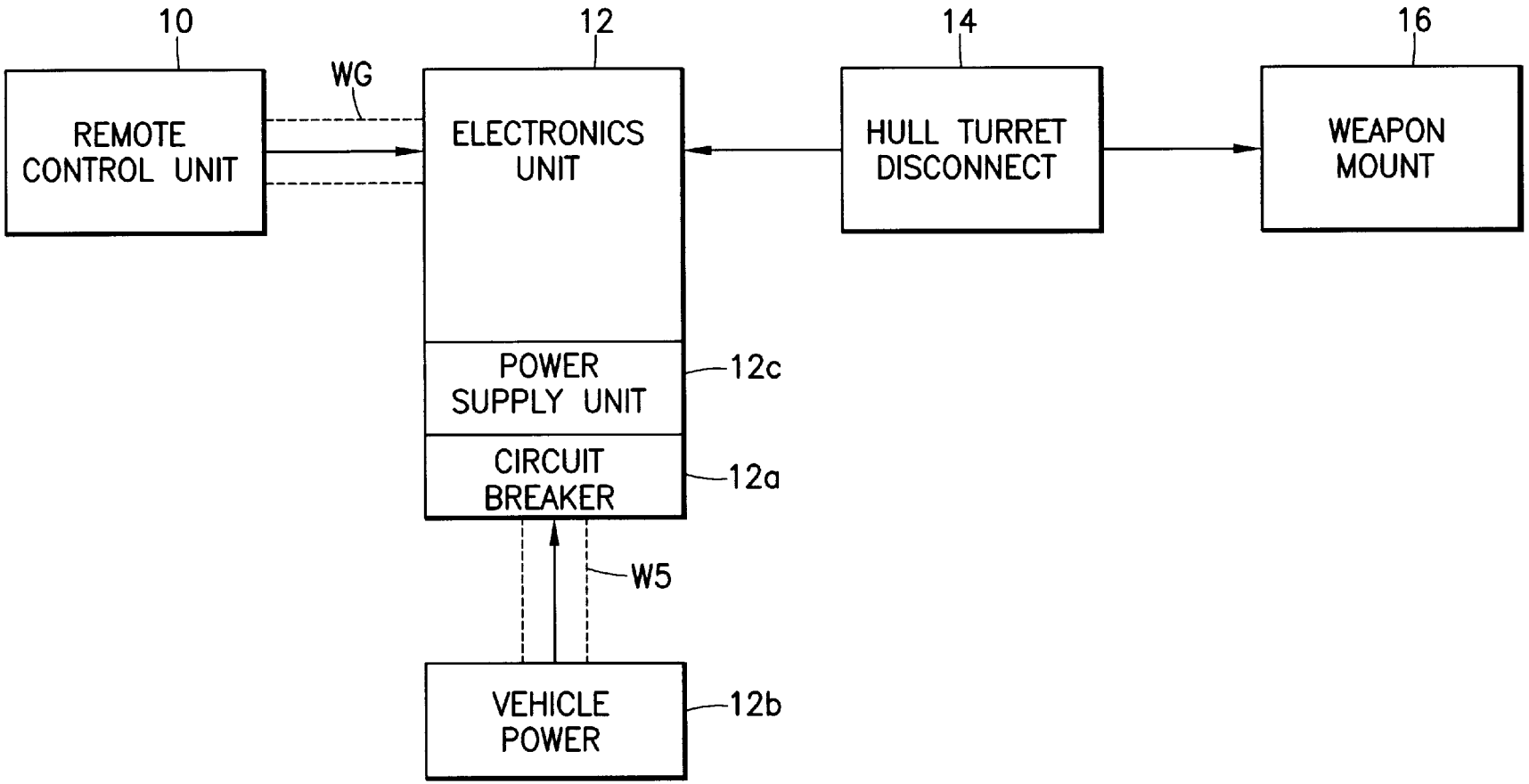
FIG. 1 illustrates the basic components of the Weapon Control System according to the invention.

As illustrated in FIG. 1, the Weapon Control System according to the invention comprises the following basic components:

(1) Remote Control Unit (RCU) 10;

(2) Electronics Unit (EU) 12;

(3) Hull Turret Disconnect (HTD) 14; and (4) Weapon Mount (WM) 16.

Figure 2B:
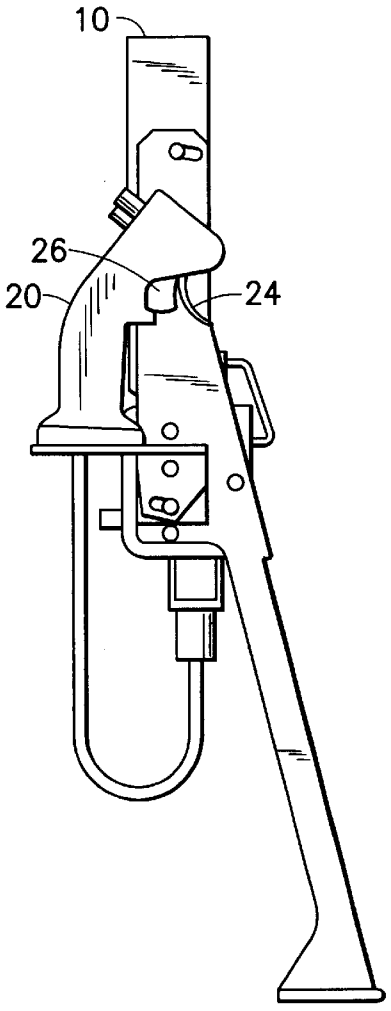
FIG. 2B is a side elevation view of the Remote Control Unit of the Weapon Control System.
Figure 2A:
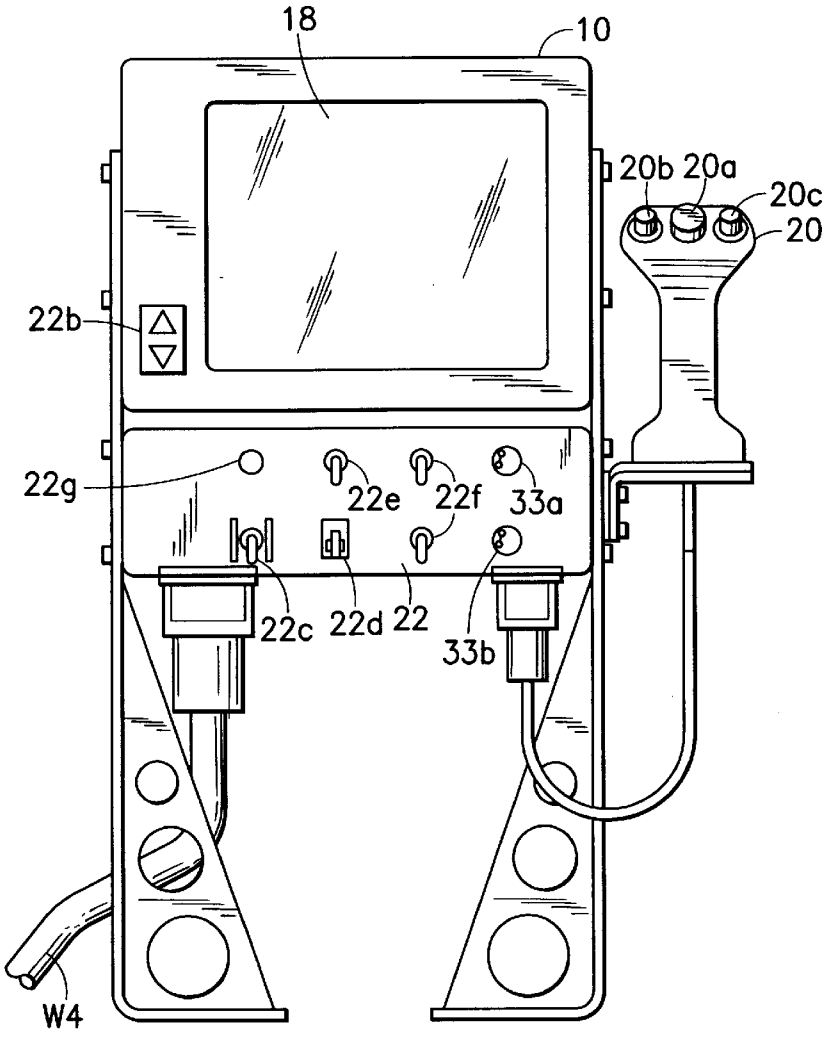
FIG. 2A illustrates a front elevation of the Remote Control Unit of the Weapon Control System.

As illustrated in FIG. 2A and 2B, the RCU 10 provides a remote operator interface to the Weapon Control System. The RCU 10 includes a video CRT display 18, handgrip 20, and control panel 22. The RCU may be located to the right rear of the driver's seat, situated so as to be operable by a crew member seated behind a vehicle driver.

The LCD display 18 of the RCU is preferably an 8 inch×6 inch black and white flat panel display, with brightness control, mounted slightly below eye level. The LCD display is preferably 2 inches thick and extends approximately 3 inches from the rear of the front passenger side seat. The RCU may be mounted on the cross supports located at the knees of the operator.

Figure 3:
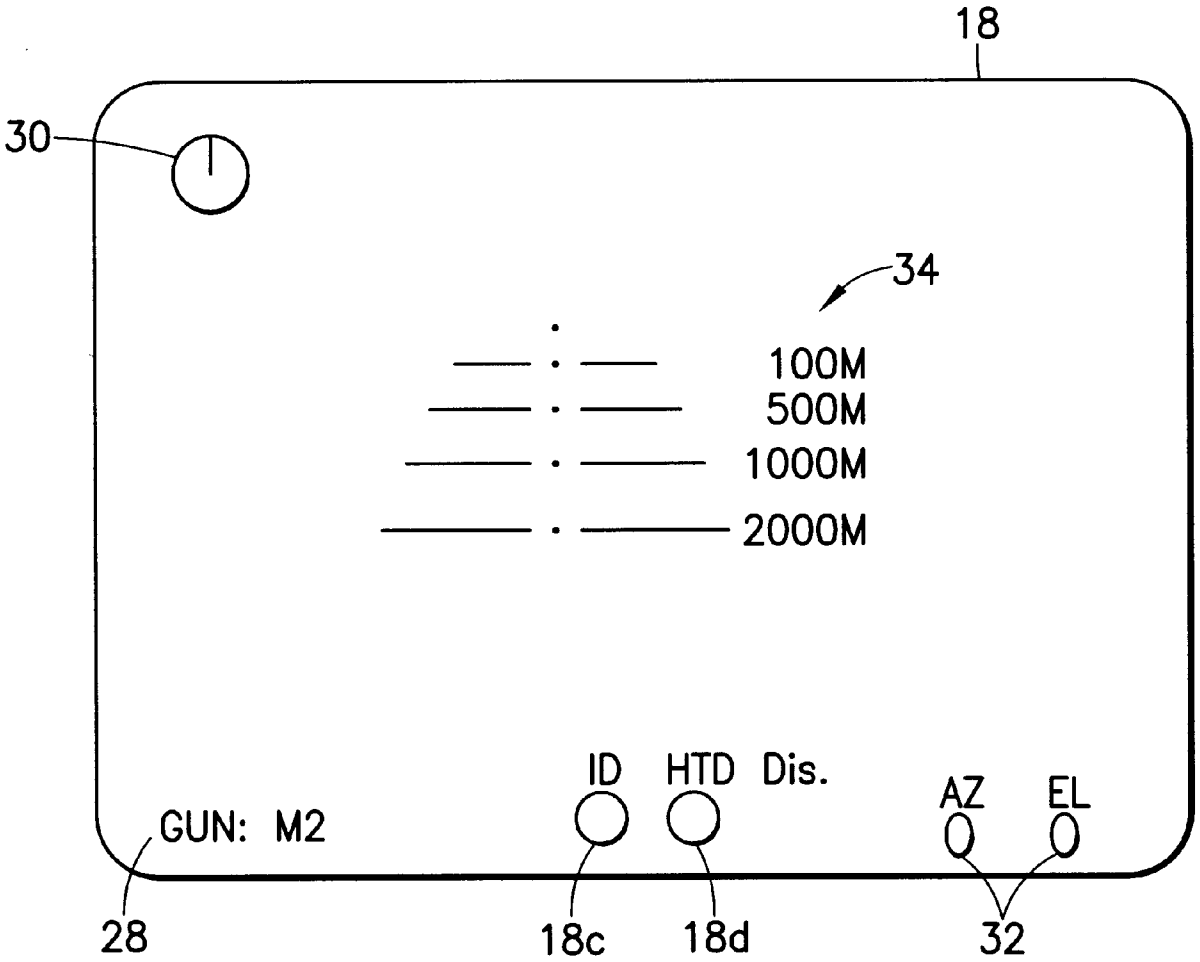
FIG. 3 illustrates typical information displayed on an LCD display of the Remote Control Unit.

The LCD display provides for viewing of camera video from the WM 16. The WM camera video includes operator messages, target reticle, and line of sight indication overlaid by the EU computer. FIG. 3 illustrates typical information displayed on LCD display 18. In particular, Gun Indicator 28 displays the type of weapon currently mounted (i.e., MK19, M2, or M60). Azimuth Indicator 30 indicates the weapon pointing direction in azimuth relative to the vehicle. Weapon Indexing Indicators indicate the indexing of the weapon in 1 mil increments when elevation and azimuth control knobs (described below) are rotated. In the center of CRT display 18 is provided Aiming Reticle 34. All the overlaid information is programmable and can easily be changed to suit specific applications.

Handgrip 20 gives the operator line of sight and fire control which is accomplished by lifting a trigger guard 24 and depressing a trigger switch 26 with the index finger (FIG. 2B). Other controls are included for power, display, and fine position adjustments. In particular, the following controls may be found at the RCU:

| | |
|---|---|
| RCU Handgrip 20 | |
| Trigger Switch 26 | Allows the weapon to be fired. A safety cover is included. |
| Thumb Transducer 20a | Controls the Weapon Mount line of sight in both axes. |
| Polarity Switch 20b | Allows the gunner to select white or black symbology. |
| Cage Switch 20c | Will slew the weapon to a predesigned position. This position can be set by the operator. |
| RCU Control Panel 22 | |
| Brightness 22b | Control the display brightness level. |
| Power 22c | Controls the system power. |
| Guarded Arm/Safe Switch 22d | Disables remote firing of the weapon; Arm - enables remote firing of the weapon. |
| Run/Setup Switch 22e | Allows normal system operation. Setup allows Set Boresight; Set Cage Position and Select Ammo. |
| Preset Function Switches 22f | Switches off screen graphics; initiates a programmed firing pattern. Allows Selection of Stablized or non-stabalized mode. |
| RCU Indicator | |
| Power 22g | Lamp to verify power to the system. |
| RCU Video Indicators | |
| Weapon Selected 28 | Indicates the type of weapon selected. |
| Target Reticle 34 | Used to aim the weapon, range data is based on the weapon selected. |
| Train Position 30 | A circle indicates the weapon mount 360 degrees of rotation, up is forward for the vehicle, a line indicates the relative aimpoint of the weapon. |

-continued

| | |
|---|---|
| Interlock Open 18c | Displayed when the HTD interlock switch is open, power and control of the weapon mount are disabled. |
| HTD Disconnected 18d | Displayed when the HTD is not connected. |

Guarded Arm/Safe Switch 22*d*: Safe—disable remote firing of the weapon; Arm—enable remote firing of the weapon. A Run/Setup Switch 22*e*: Run—allows normal system operation; Setup—allows the following three setup options:

(1) Set Boresight—when boresighting the weapon to the camera this option allows fine adjustment of crosshairs in elevation and azimuth to meet the boresight target, by rotating the elevation and the azimuth control knobs, depressing the knobs fixes position. This position then becomes the range 0 reticle crosshair.

(2) Set Cage Position—this option is used when a preset elevation and azimuth position is desired. The weapon is positioned to the desired cage position, and depressing the elevation knob will set the weapon to the (new) cage position. Recalling that cage position is then accomplished by depressing the Cage Switch on the handgrip.

(3) Select Ammo—this option is used when choosing an ammunition for the weapon placed in the weapon mount. The choice of ammunition dictates the type of aiming reticle placed on the display.

Preset Function Switches 22*g:*

F1 turns off screen graphics.

F2 initiates a programmed firing pattern.

F3 stabalized Mode.

F4 unstabalized Mode.

After selecting either F3 or F4, and moving the toggle switch to the neutral position between F3 and F4 is preferably normal operating mode.

An elevation control knob 33*a* may be provided for use in various setup functions and to reposition the aimpoint of the weapon at, e.g., 1 mil increments in elevation (FIG. 3). An azimuth control knob 33*b* may be provided for use in various setup functions and to reposition the aimpoint of the weapon at, e.g., 1 mil increments in azimuth. Video indicators 32 display Azimuth and Elevation positions in one mil increments. A line-of-sight handgrip control (thumb transducer) 20*a* (FIG. 2A) may be provided for use to control the weapon pointing direction.

The electronics unit 12 is a compact light weight controller for the weapon system and integral sight. For purposes of clarity, the description of the Electronics Unit 12 will proceed with numbers starting in the 100 series. The electronics unit 12 features an industry standard computer bus 100 architecture featuring a state-of-the-art embedded controller 101 based on the Intel class of CPU's. The computer architecture is expandable with 4 spare slots indicated generally at 102, to support additional capability for target tracking, fire control and advanced sights or weapons.

The computer bus is powered from a compact, rugged power supply 104 that meets the severest military vehicle requirements for environment as well as input power. A special purpose card 106 interfaces the handgrip control to a standard industrial motor controller 108 on the computer bus. The motor controller 108 drives two power amplifiers 110, 112 for control of train and elevation. Standard industrial control algorithms are modified by the embedded controller to offer drift-free rate control of the LOS (Line of Sight) using an encoder position feedback scheme. Sub milli-radians position accuracy is maintained by the encoder position feedback of motor position.

The two state-of-the-art power amplifiers 110, 112 are used to maintain a high bandwidth current loop around the elevation and train motors. The power amplifiers running at a high switching frequency to reduce power dissipation and increase efficiency are used to control the brushless motors. The amplifiers are supplied from a high voltage bus. The high voltage bus helps to reduce IR losses in the current drive to the elevation and train motors. A compact power supply develops the correct voltage from standard vehicle input power of 24 volts. The system can meet all its performance parameters running at 100 watts continuous with surge requirements of 600 watts. This will allow operation in a variety of low power vehicles as well as reduce IR signature of the sight and electronics in surveillance mode.

The video interface 120 is supplied by a video graphics printed circuit board 122 running on the same embedded computer bus. The graphics card captures the sights video and adds annotated position information and the appropriate aiming reticle. Advanced features of video and digital image downloading are also performed by the graphics card with control from the embedded processor. The command interface is a user friendly graphics display with installation, built-in test, and operator feature control algorithms.

All the electronics include current limit and over-voltage protection as well as automatic recovery from shutdown due to over-voltage or over-current. The system will continue operating during vehicle starting when the available voltage drops to 6 volts.

The EU 12 contains a circuit breaker 12*a* for the vehicle power input 12*b*. The EU may be mounted, for example, in the vehicle's trunk space above the right rear wheel, in the ammunition storage area.

The HTD 14 provides two system functions. Because the weapon is mounted on a rotable ring, a quick disconnect function is provided to allow free rotation for full operation in the Local Mode. For remote operation, the turret is locked into a forward position and the HTD connected. The second function is a Safety Interlock (not shown) to prevent remote weapon movement and firing when the HTD is connected and an operator opens a turret hatch on the vehicle.

Figure 4:
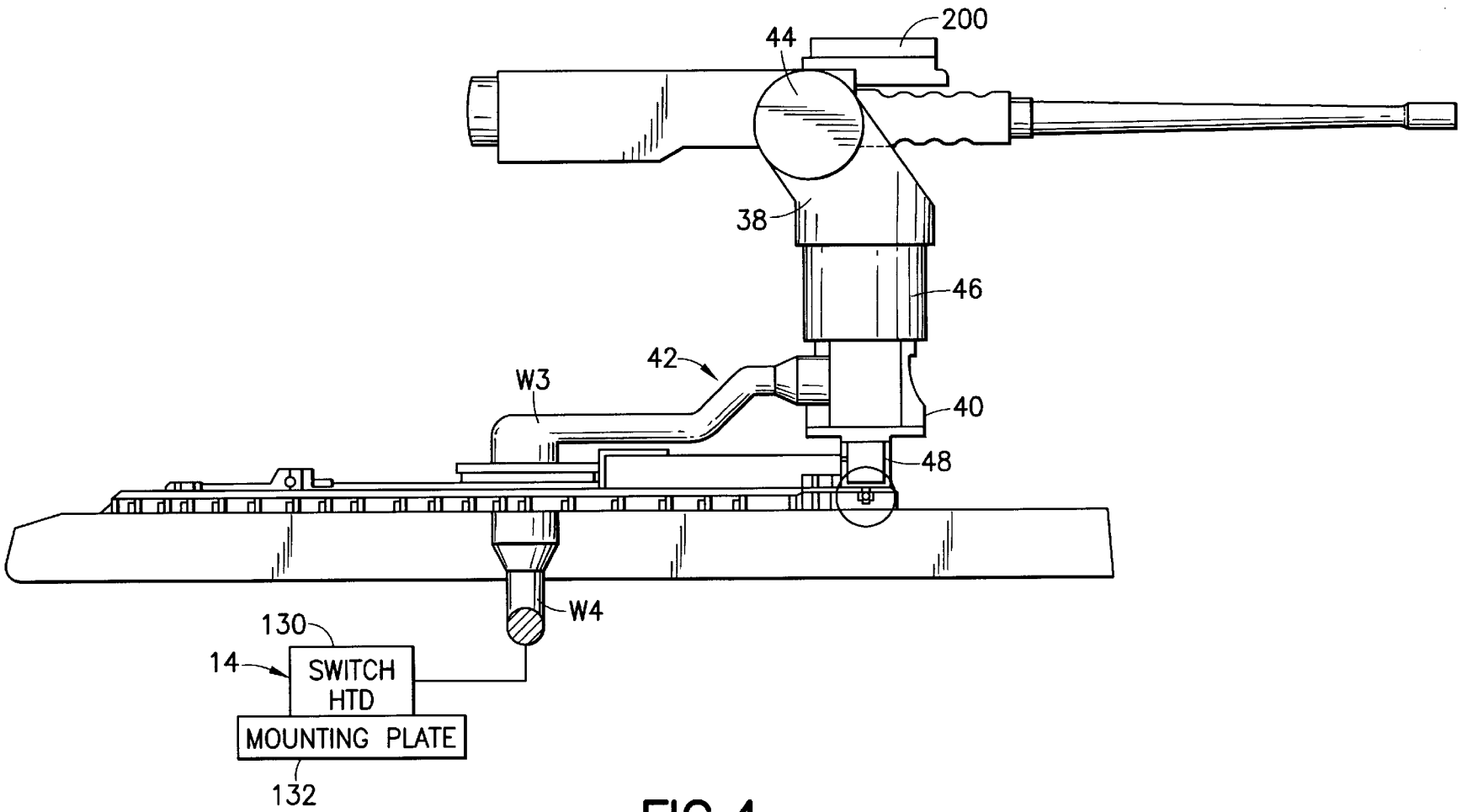
FIG. 4 illustrates a Weapon Mount of the Weapon Control System.

The WM 16 illustrated in FIG. 4 includes the stabalization/sensor assembly 200, weapon mounting 38, vehicle adapter plate 40, interconnection cables 42, elevation assembly 44, and drive train assembly 46. The WM is attached to the top of the vehicle and the electrical connections are routed through a hole in the turret to an electrical connector inside of the vehicle. A standard pintle receptacle 48 is used for the weapon mount to vehicle interface. A Weapon-Specific Solenoid (not shown) is attached to the installed weapon for remote firing.

The absolute pointing accuracy of the WM is preferably less than 1 milliradian. The WM may be adapted to provide 60 deg/sec/sec acceleration and 45 deg/sec velocity. The drive train is preferably free to rotate and the elevation may go from −15 deg to +45 deg with an adjustable lower stop.

The camera 202 may be a CCD imager with an automatic electronic shutter and fixed focus. Boresight retention is preferably at least 0.5 milliradians and camera resolution at least 470 lines in an RS-170 interlaced format.

Power from the vehicle batteries is connected directly to the EU 12. Interunit cabling then connects the EU to the WM and the EU to the RCU. The interunit cabling comprises pre-made cables attached with environmental connectors as follows:

Cable W3, external to the vehicle, runs from the base of the WM to a CFE adapter plate mounted either within or in place of a night vision platform mount;

Cable W4 (FIG. 2A) mates with cable W3 from within the vehicle at the adapter plate and terminates at the EU. Cable W4 must be disconnected at the adapter plate in order for the turret to be rotated. The disconnected W4 cable is preferably mated to a CFE dummy connector mounted internally to the fixed non-rotating portion of the vehicle roof so as to keep it protected while not in use. A HTD switch 130 is preferably mounted within the length of the W4 cable on a CFE mounting plate 132 installed so that opening the turret hatch will interrupt power to the mount.

Cable W5 (FIG. 1) is a power cable for the Weapon Control System. Preferably, a 4 awg cable is run from a vehicle power source to the EU 12.

Cable W6 runs from the EU 12 back to the RCU 10.

Cables W4 and W6 must run through the passenger compartment of the vehicle as well as through the armored dividing wall between the trunk and the passenger compartment.

Upon powering up, the Weapon Control System senses weapon type (e.g., MK19, M2, M60) that is placed in the WM 16. This, in turn dictates an automatic selection of the correct software for each weapon reticle and control variables assuring precise and accurate movement. Once the system is powered-up the operator interface to the Weapon Control System is through the RCU 10.

The Weapon Control System has two modes of operation, local and remote:

(1) Local Mode—When the vehicle hatch is opened, the WM motors and firing solenoids are disabled by an interlock switch. This safety feature allows the gunner to treat the system as a standard mount. Otherwise, local firing operation of the weapon is unchanged.

(2) Remote Mode—Once the weapon and mount are loaded and prepped, remote firing is done from within the vehicle. The gunner aims the weapon using the handgrip control. Targeting is done using a computer generated reticle overlaid on the live WM camera video. Two rotary controls allow slight offsets to the aimpoint similar to the manual T&E assembly. Train position relative to the vehicle is displayed with the camera video.

Figure 5:
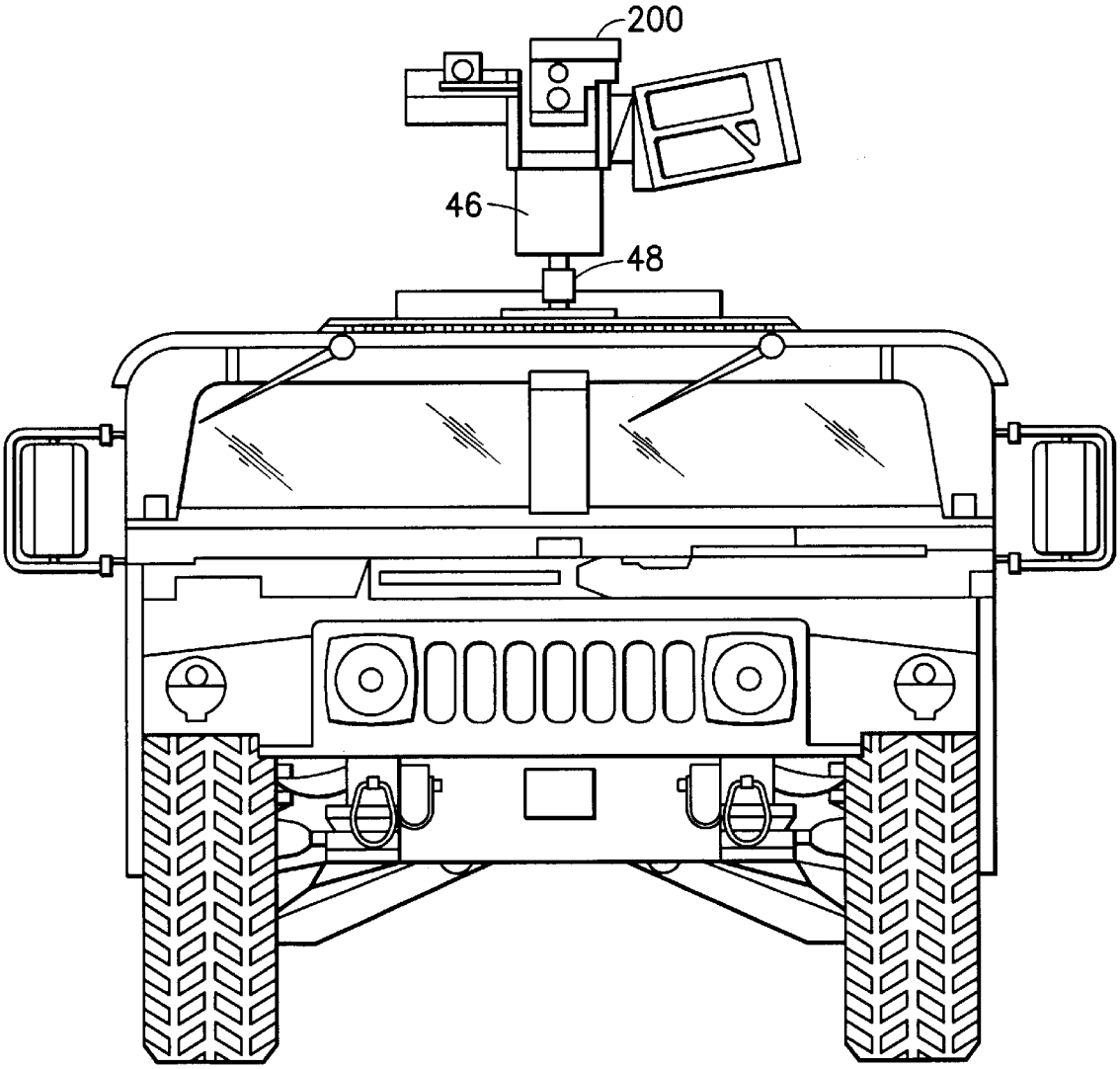
FIG. 5 is a front view of a vehicle showing the positioning of the Weapon Control System.
Figure 6:
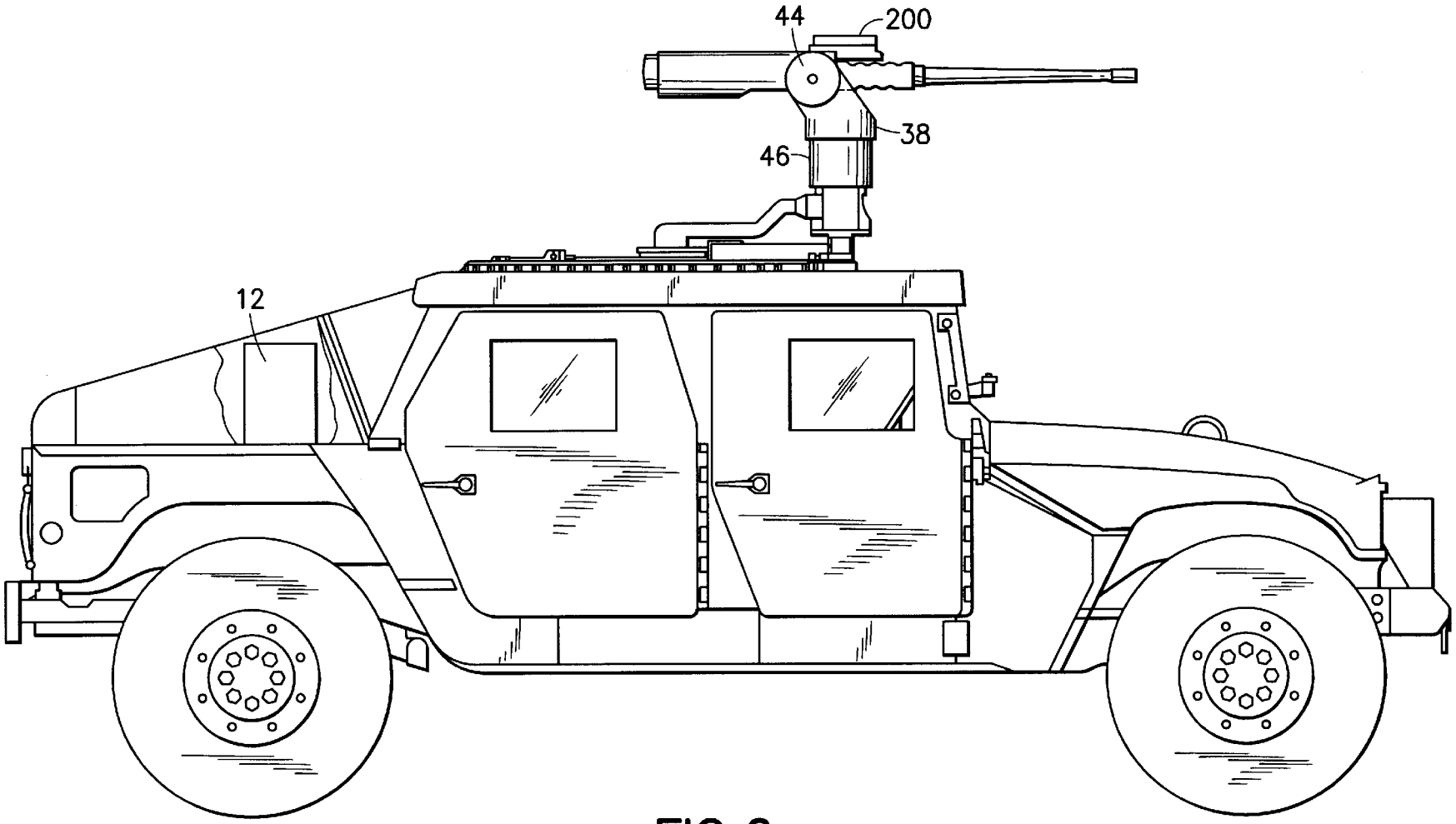
FIG. 6 is a side view of the vehicle showing the positioning of the Weapon Control System.
Figure 7:
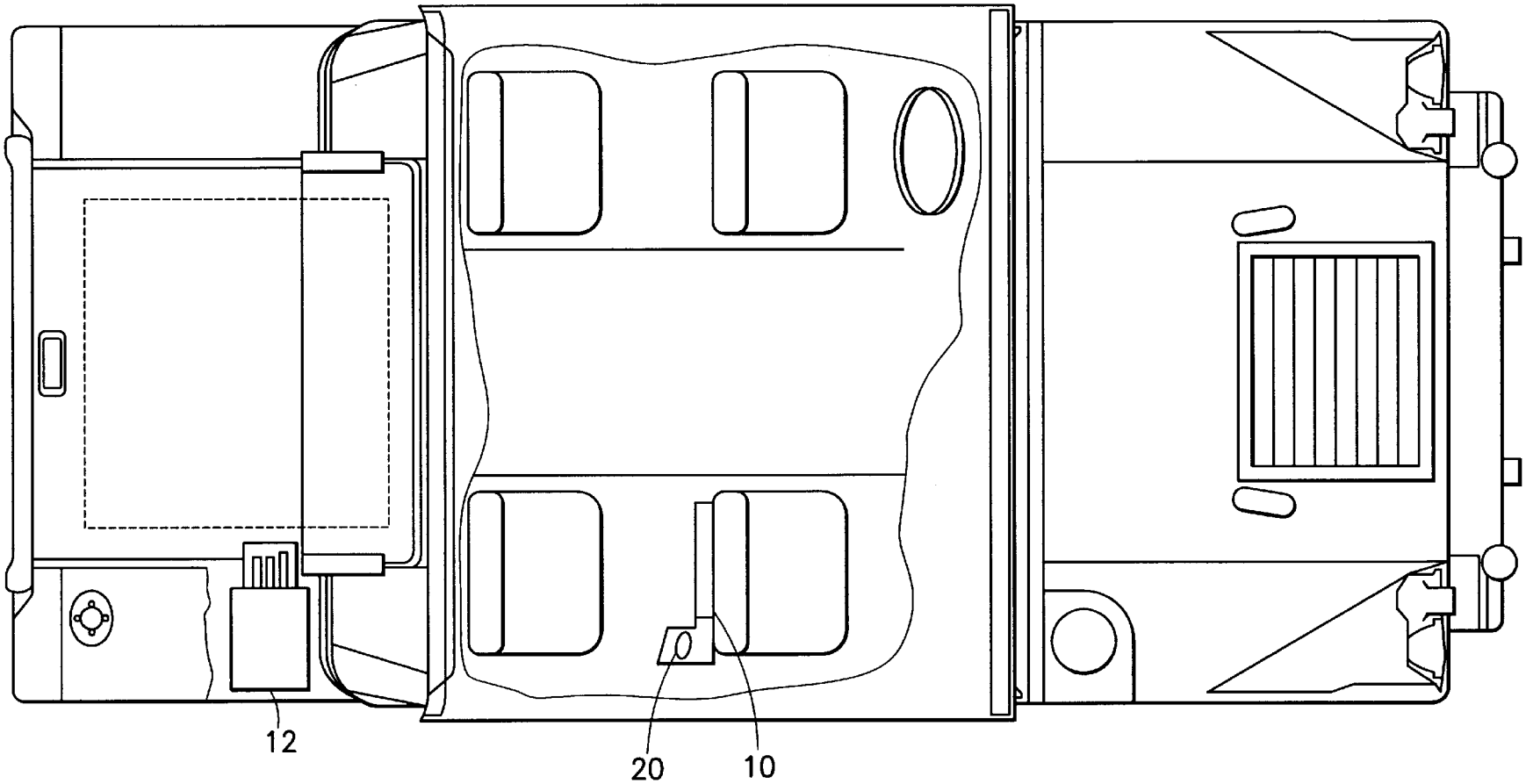
FIG. 7 is a top sectional view of the vehicle showing the positioning of the Weapon Control System.
Figure 8:
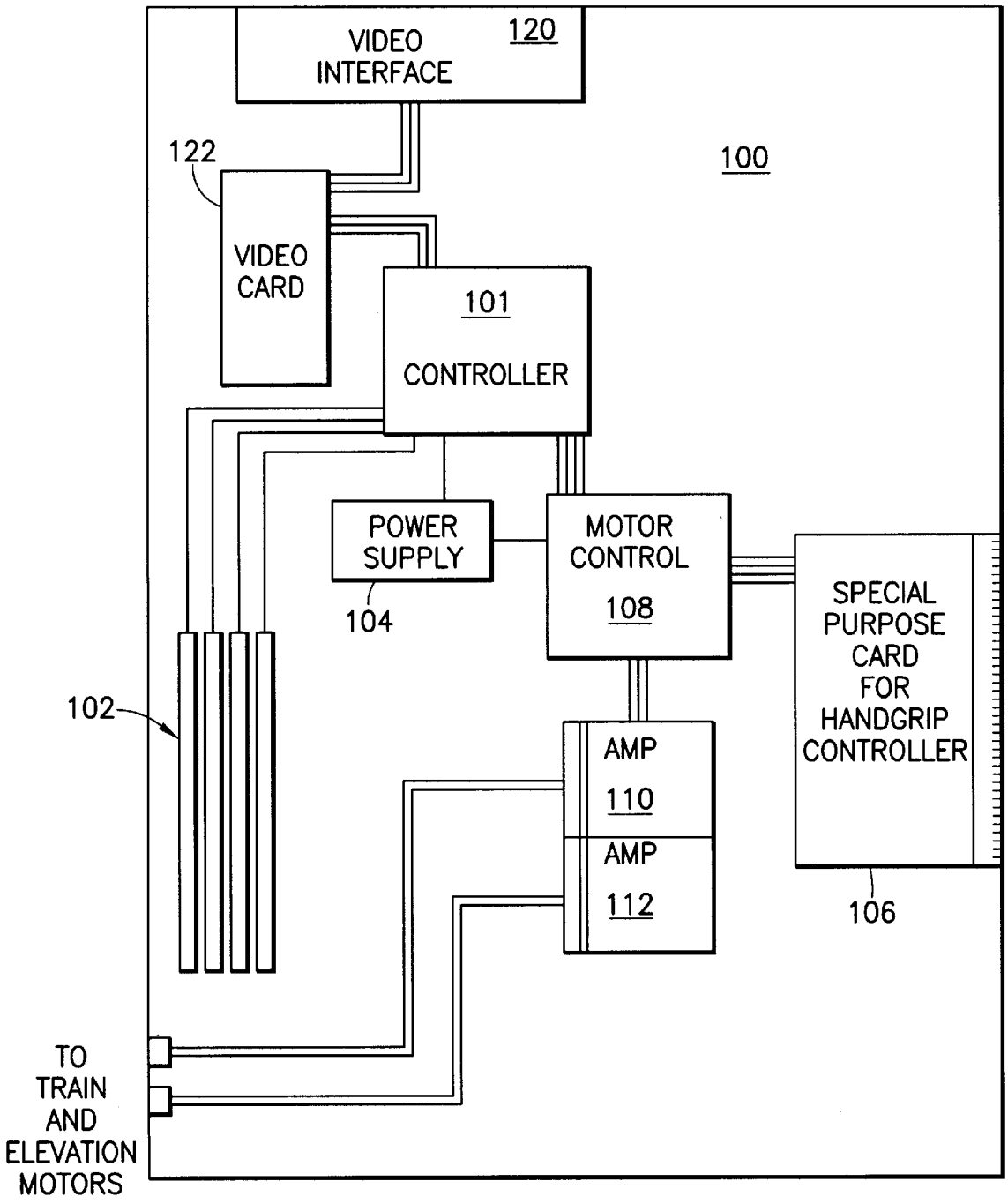
FIG. 8 is a schematic illustration of the basic components of the Electronic Unit.

FIGS. 5, 6, and 7 illustrate the Weapon Control System as installed in a XM1114HMMWV scout vehicle. In particular, FIG. 5 is a front view of the vehicle showing the positioning of the weapon and the WM on the vehicle. FIG. 6 is a side view of the vehicle showing the positioning of the weapon, the WM, and the EU on and within the vehicle. FIG. 7 is a top sectional view of the vehicle showing the positioning of the RCU and the EU within the vehicle.

It may be appreciated that the interior components of the Weapon Control System will not interfere with vehicle crew members' operational space. The RCU is preferably disposed in a location free of other equipment. The RCU location can be adjusted to accommodate different mission load requirements. The EU is preferably disposed in unutilized trunk space.

It may be further appreciated that integration of the Weapon Control System into the vehicle will not require major vehicle modifications, will not interfere with existing component or crew space claims, and will not degrade vehicle performance with regard to weight or power requirements.

Figure 14B:
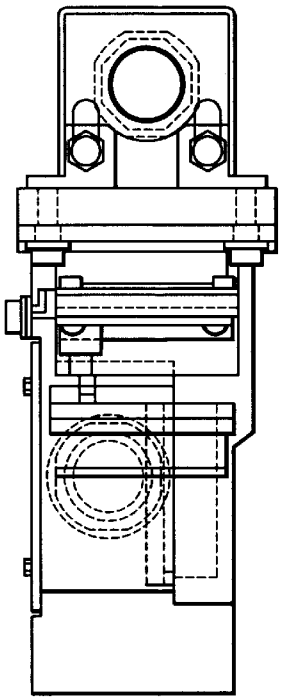
FIG. 14*b* shows the front view of the stabalization/sensor assembly looking in the direction of arrow 14*b*.
Figure 14:
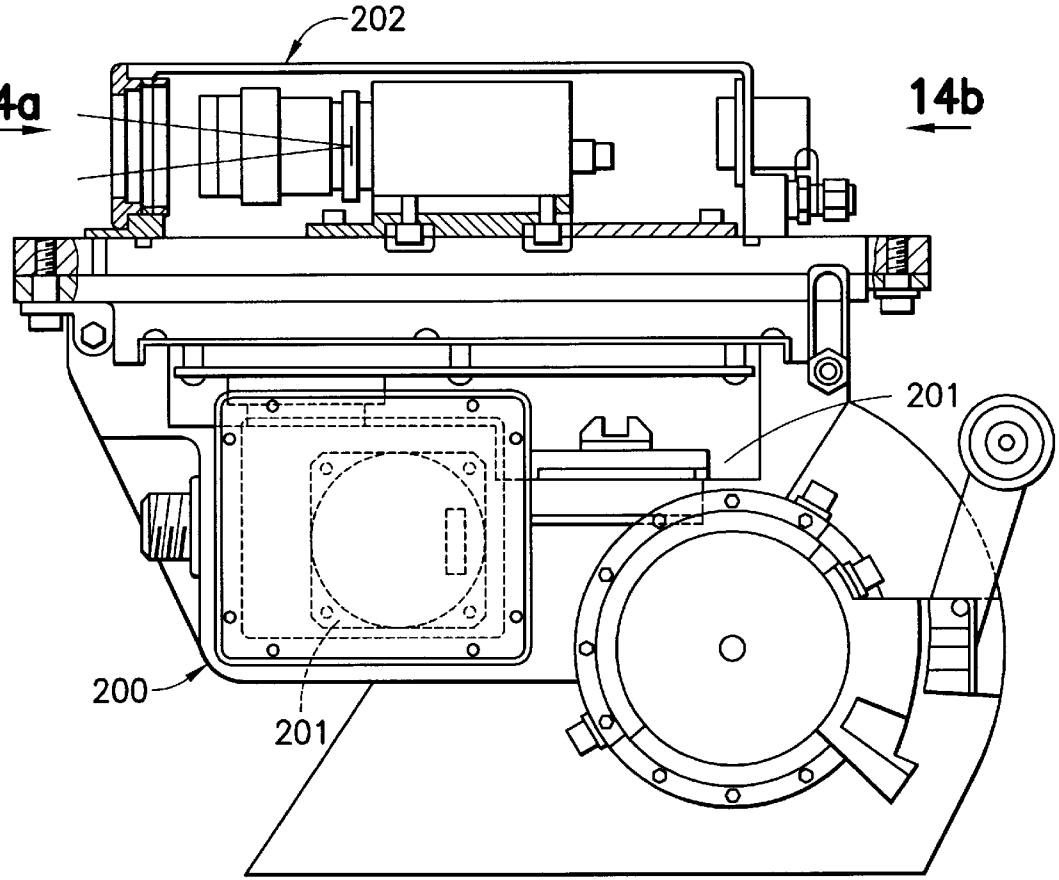
FIG. 14 shows the stabalization/sensor assembly.
Figure 14A:
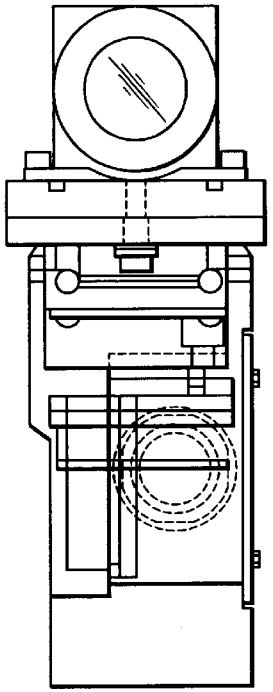
FIG. 14*a* shows the front view of the stabalization/sensor assembly looking in the direction of arrow 14*a*.

Referring now to FIG. 14, there is illustrated at 200 a stabilization assembly, mounted on the weapon mount forming a gyro stabilized mechanism of the Weapon Control System, which offers line-of-sight weapon and integral sight stabilization. The stabilization assembly 200 is designed around state-of-the-art fiber optic gyros 201, offering long life, low drift and high shock performance in a compact light weight package. The assembly 200 can incorporate two single axis gyros for sensing elevation and train rate error within the gyro assembly. Null corrected drift rate is less than 5°/hr. The stabilization assembly 200 is mounted on the axis of the weapon mount 16 in proximity to the gun to get the closest line-of-sight rate error of the gun's motion. The integral sight is adjustable in elevation and azimuth and is hard mounted to the assembly 200 in the stabilized option.

The unmanned stabilization accuracy with a full ammunition can and heavy weapon is 3 mils peak to peak (PK/PK) and less than 1 mil root mean squared (RMS) for a 15 mph bump and 20 mph zigzag course.

In accordance with the present invention, the stabilization system control is selected by the operator at the RCU 10 via the F3 function switch (FIG. 2). The default state of the Weapon Control is gyro stabilized. Null drift adjust is available in azimuth 33*b* and elevation 33*a* from encoders on the RCU 10. The gyro stabilized mode is available instantly on power up because of the zero warm-up time of the fiber optic gyro.

Processing of the gyro rate error signals are performed in the Electronics Unit 12 by the standard industrial motor controller 108. Optional control algorithms for stabilization signals are embedded in the firmware on the main CPU of the Electronics Unit 12.

Figure 9:
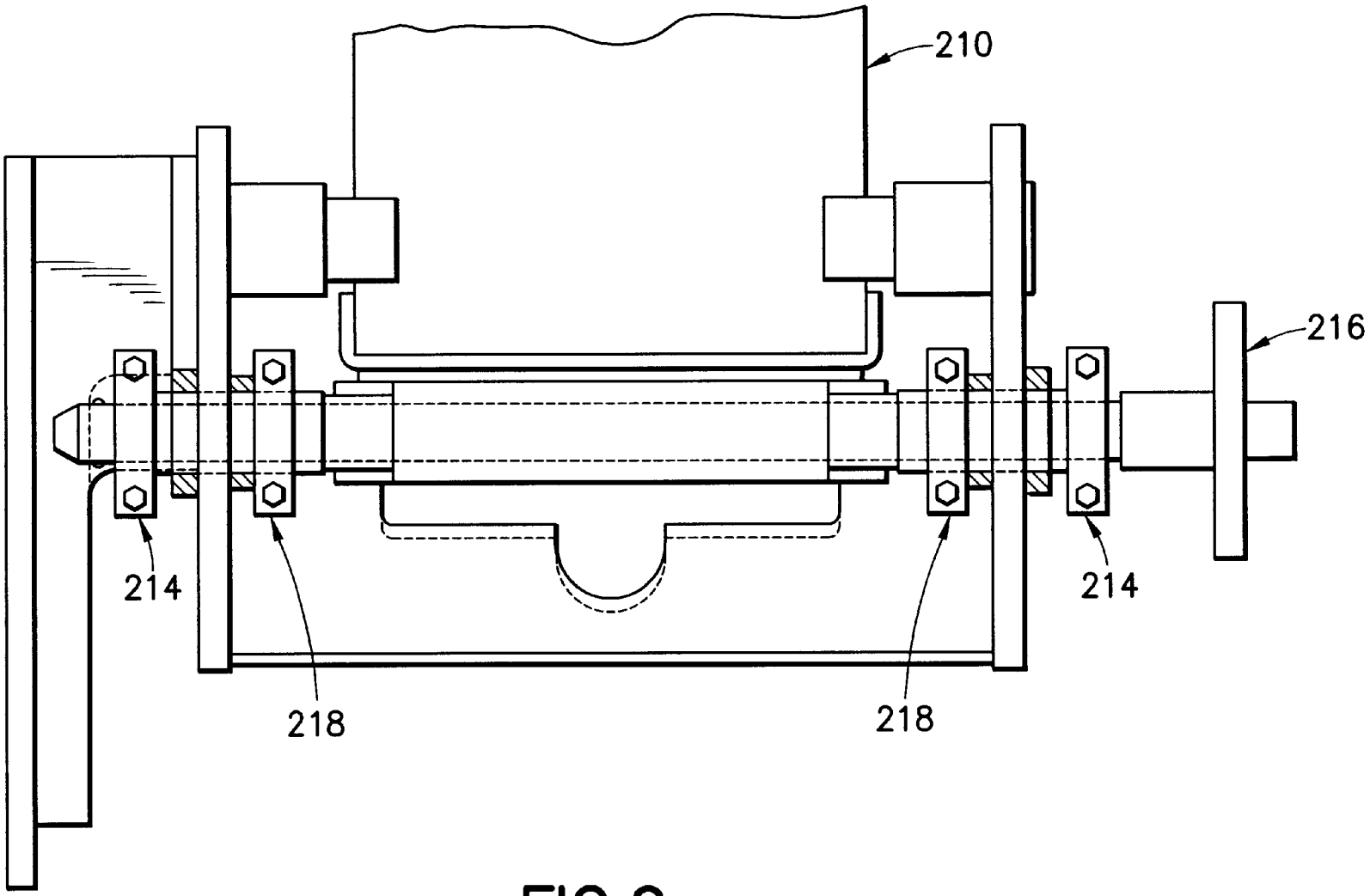
FIG. 9 is a schematic rear elevation view of the assembly for mounting a MK19 machine gun.
Figure 10:
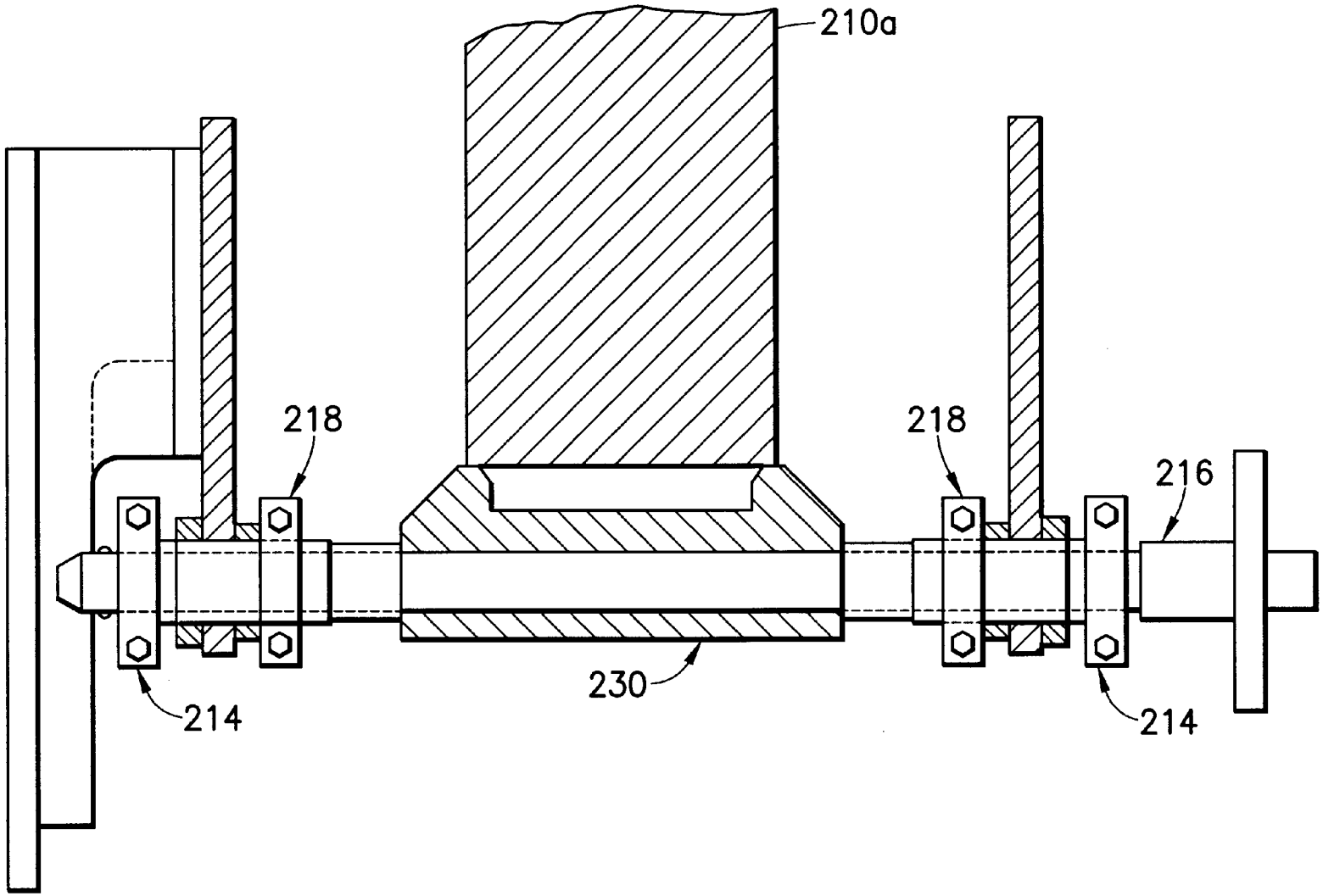
FIG. 10 is a partial sectional view showing the horizontal clamping system used for mounting the M2.
Figure 11:
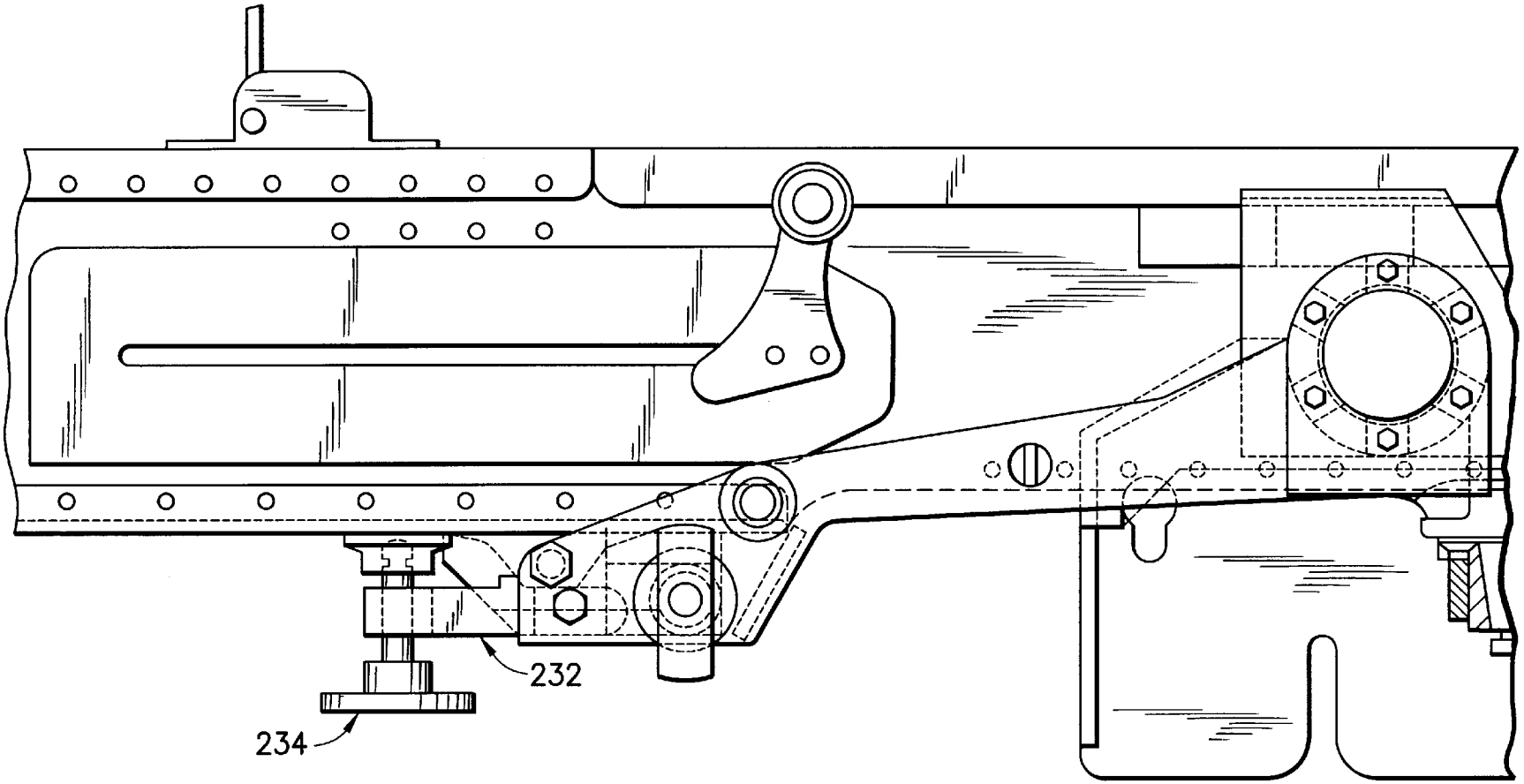
FIG. 11 shows a vertical mount and adjustment handle for mounting a M2.
Figure 12:
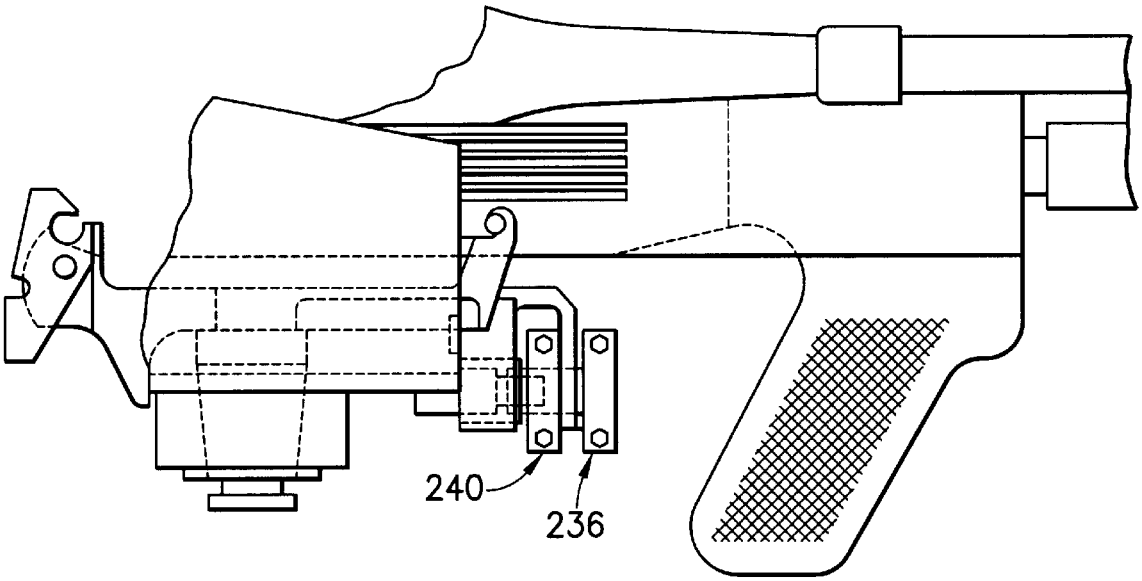
FIGS. 12 and 13 show a clamping system used for mounting a M60 gun.
Figure 13:
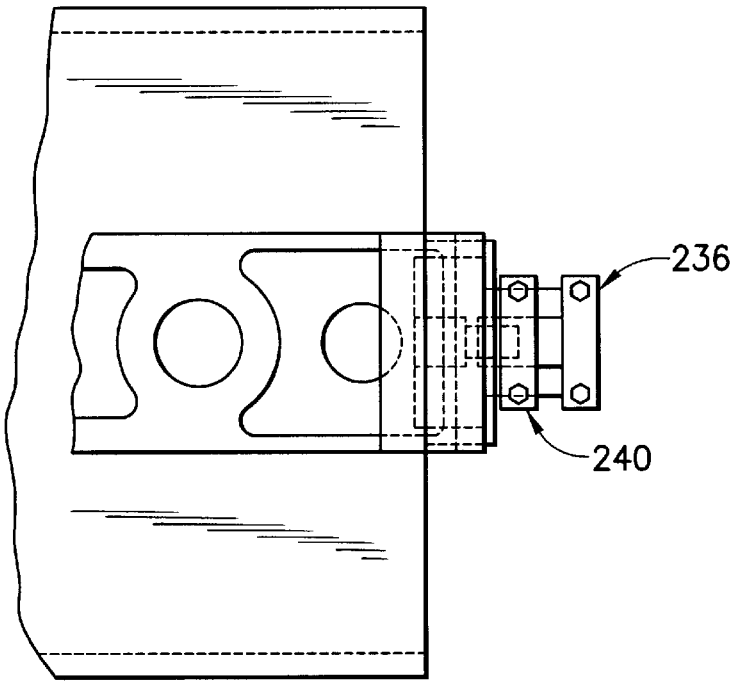

A necessary and important element of any gyro stabilized system is the capability to keep all moving parts under control and rigidly mounted. This can be difficult to accomplish on a weapon such as a machine gun because of the many loose fitting parts inherent to its operation. The gun assembly and its mounting interfaces are not designed as a rigid structure. Any close fitting mounting interfaces on a new weapon will loosen over time due to the recoil and counter recoil forces acting on them. The Weapon Control System has a mounting interface which securely holds the MK19, M2 and M60 machine guns in the cradle, and will allow the weapons to be securely mounted even as the mounting interfaces wear from use. FIG. 9 shows a weapon 210, illustrated as the MK19 machine gun, having Clamping Bolts 214, which are fine pitch threaded and used to clamp the rear of the weapon from side to side, as the weapon is held in place with the Retaining Pin 216. The Knurled Nuts 218 prevent any loosening under load. The M2 (210*a*) .50 cal machine gun uses the same hardware in the same manner (FIG. 10). The M2 requires a one piece .50 cal. Aft Mount 230 to secure the assembly. In addition, FIG. 11 shows the M2 has a Vertical Mount 232 and Adjustment Handle 234 which removes all looseness in the vertical direction. The assembly as a whole allows the variations in weapons to be accommodated as well as the take-up "slop" as weapons wear out. FIG. 12 shows a similar clamping scheme for the M60 (210*b*), with a Clamping Bolt 236 and a Knurled Nut 240. FIG. 13 is an enlarged view of FIG. 12, showing the clamping bolt 236 and knurled nut 240. Due to the low recoil forces of this weapon, only one central Clamping Bolt 236 located on the vertical barrel centerline is required and removes free gun movement in azimuth. The standard M60 mounting pintle eliminates free movement in elevation. Live fire testing has shown the rigid mounting of the weapons in this manner allows the Weapon Control System dispersion to be equivalent to the weapon's dispersion.

While the invention has been described in its preferred embodiments, it is to be understood that the words which have been used are words of description, rather than limitation, and that changes may be made within the purview of the appended claims without departing from the true scope and spirit of the invention in its broader aspects.

What is claimed:

1. A weapon control system, comprising:

system electronics providing control and drive electronics for the weapon control system;

a weapon mount for supporting and firing a weapon in accordance with commands from said system electronics;

a remote control including a visual display and hand controls for operational control of the weapon control system from a position distant from said weapon mount; and a system disconnect for removal of control of the weapon from the weapon control system and for safety interlock to prevent accidental firing of the weapon;

wherein said weapon mount will support and fire a variety of weapons;

a gyro stabilization assembly mounted on the weapon mount and operatively connected to the remote control and the system electronics for line-of-sight weapon and integral sight stabilization; and wherein said gyro stabilization assembly has a null corrected drift rate less than 5°/hr.

2. A weapon control system according to claim 1, wherein said gyro stabilization assembly includes at least one gyro for sensing elevation and train rate error.

3. A weapon control system according to claim 1, wherein said null corrected drift rate can be adjusted in azimuth and elevation.

4. A weapon control system according to claim 1, wherein said hand controls include a handgrip adapted to be operated by one hand and having a trigger guard and trigger switch for allowing the weapon to be fired, a thumb transducer for controlling a weapon mount line of sight in two axes, a polarity switch for allowing a gunner to select white or black symbology on the visual display, and a cage switch for slewing the weapon to a predetermined position which can be set by the operator.

5. A weapon control system according to claim 1, wherein said remote control includes a plurality of video indicators, including a target reticle for aiming the weapon, a weapon selected video indicator for indicating the type of selected weapon, a train position for indicating the weapon mount rotation, an offset data video indicator for displaying an offset of the weapon as input with a plurality of offset controls when enabled, and an interlock open video indicator for displaying when a hull turret disconnect is not connected.

6. A weapon control system according to claim 1, including a plurality of preset function switches for turning off screen graphics, initiating a programmed firing pattern, reviewing a previously stored display scene, and storing a current display scene.

7. A weapon control system according to claim 1, wherein said remote control includes an elevation control knob for repositioning the aimpoint of the weapon in 1 mil elevation increments.

8. A weapon control system according to claim 1, wherein said remote control includes an azimuth control knob for repositioning the airpoint of the weapon in 1 mil increments of azimuth.

9. A weapon control system, comprising:

system electronics providing control and drive electronics for the weapon control system;

a weapon mount for supporting and firing a weapon in accordance with commands from said system electronics;

a remote control including a visual display and hand controls for operational control of the weapon control system from a position distant from said weapon mount; and a system disconnect for removal of control of the weapon from the weapon control system and for safety interlock to prevent accidental firing of the weapon;

a computer bus having expansion slots for supporting additional capability for target tracking, fire control and advanced sights or weapons;

wherein said weapon mount will support and fire a variety of weapons; and a gyro stabilization assembly mounted on the weapon mount and operatively connected to the remote control and the system electronics.

10. A weapon control system according to claim 9, wherein said gyro stabilization assembly includes at least one gyro for sensing elevation and train rate error.

11. A weapon control system according to claim 9, wherein said gyro stabilization assembly has a null corrected drift rate less than 5°/hr.

12. A weapon control system according to claim 11, wherein said null corrected drift rate can be adjusted in azimuth and elevation.

13. A weapon control system according to claim 9, wherein said system electronics include two power amplifiers for controlling train and elevation.

14. A weapon control system according to claim 9, including a motor controller for controlling two power amplifiers.

15. A weapon control system according to claim 9, wherein power amplifiers maintain a high bandwidth current loop around elevation and train motors.

16. A weapon control system according to claim 9, wherein said hand controls include a handgrip adapted to be operated by one hand and having a trigger guard and trigger switch for allowing the weapon to be fired.

17. A weapon control system according to claim 9, including a thumb transducer positioned on the hand grip for controlling a weapon mount line of sight in two axes.

18. A weapon control system according to claim 9, including a polarity switch positioned on the handgrip for allowing a gunner to select white or black symbology the visual display.

19. A weapon control system according to claim 9, including a cage switch positioned on the handgrip for slewing the weapon to a predetermined position which can be set by the operator.

20. A weapon control system according to claim 9, wherein said remote control includes a plurality of video indicators, including a target reticle for aiming the weapon, a weapon selected video indicator for indicating the type of selected weapon, a train position for indicating the weapon mount rotation, an offset data video indicator for displaying an offset of the weapon as input with a plurality of offset controls when enabled, and an interlock open video indicator for displaying when a hull turret disconnect is not connected.

21. A weapon control system according to claim 9, including a plurality of preset function switches for turning off screen graphics, initiating a programmed firing pattern, reviewing a previously stored display scene, and storing a current display scene.

22. A weapon control system according to claim 21, wherein said remote control includes an elevation control knob for repositioning the aimpoint of the weapon in 1 mil elevation increments.

23. A weapon control system according to claim 22, wherein said remote control includes an azimuth control knob for repositioning the airpoint of the weapon in 1 mil increments of azimuth.

24. A weapon control system, comprising:

system electronics providing control and drive electronics for the weapon control system;

a weapon mount for supporting and firing a weapon in accordance with commands from said system electronics;

a remote control including a visual display and hand controls for operational control of the weapon control system from a position distant from said weapon mount; and a system disconnect for removal of control of the weapon from the weapon control system and for safety interlock to prevent accidental firing of the weapon;

wherein said weapon mount will support and fire a variety of weapons;

a gyro stabilization assembly mounted on the weapon mount and operatively connected to the remote control and the system electronics for line-of-sight weapon and integral sight stabilization; and wherein said gyro stabilization assembly has a null corrected drift rate which can be adjusted in azimuth and elevation.

25. A weapon control system, comprising:

system electronics providing control and drive electronics for the weapon control system;

a weapon mount for supporting and firing a weapon in accordance with commands from said system electronics;

a remote control including a visual display and hand controls for operational control of the weapon control system from a position distant from said weapon mount; and a system disconnect for removal of control of the weapon from the weapon control system and for safety interlock to prevent accidental firing of the weapon;

wherein said weapon mount will support and fire a variety of weapons;

a gyro stabilization assembly mounted on the weapon mount and operatively connected to the remote control and the system electronics for line-of-sight weapon and integral sight stabilization; and wherein said hand controls include a handgrip adapted to be operated by one hand and having a trigger guard and trigger switch for allowing the weapon to be fired, a thumb transducer for controlling a weapon mount line of sight in two axes, a polarity switch for allowing a gunner to select white or black symbology on the visual display, and a cage switch for stewing the weapon to a predetermined position which can be set by the operator.

26. A weapon control system, comprising:

system electronics providing control and drive electronics for the weapon control system;

a weapon mount for supporting and firing a weapon in accordance with commands from said system electronics;

a remote control including a visual display and hand controls for operational control of the weapon control system from a position distant from said weapon mount; and a system disconnect for removal of control of the weapon from the weapon control system and for safety interlock to prevent accidental firing of the weapon;

wherein said weapon mount will support and fire a variety of weapons;

a gyro stabilization assembly mounted on the weapon mount and operatively connected to the remote control and the system electronics for line-of-sight weapon and integral sight stabilization; and wherein said remote control includes a plurality of video indicators, including a target reticle for aiming the weapon, a weapon selected video indicator for indicating the type of selected weapon, a train position for indicating the weapon mount rotation, an offset data video indicator for displaying an offset of the weapon as input with a plurality of offset controls when enabled, and an interlock open video indicator for displaying when a hull turret disconnect is not connected.

27. A weapon control system, comprising:

system electronics providing control and drive electronics for the weapon control system;

a weapon mount for supporting and firing a weapon in accordance with commands from said system electronics;

a remote control including a visual display and hand controls for operational control of the weapon control system from a position distant from said weapon mount; and a system disconnect for removal of control of the weapon from the weapon control system and for safety interlock to prevent accidental firing of the weapon;

wherein said weapon mount will support and fire a variety of weapons;

a gyro stabilization assembly mounted on the weapon mount and operatively connected to the remote control and the system electronics for line-of-sight weapon and integral sight stabilization; and including a plurality of preset function switches for turning off screen graphics, initiating a programmed firing pattern, reviewing a previously stored display scene, and storing a current display scene.

* * * * *